US009273589B2

(12) United States Patent
Shimizu et al.

(10) Patent No.: US 9,273,589 B2
(45) Date of Patent: Mar. 1, 2016

(54) EXHAUST APPARATUS FOR INTERNAL COMBUSTION ENGINE

(71) Applicant: HONDA MOTOR CO., LTD., Tokyo (JP)

(72) Inventors: Kouhei Shimizu, Wako (JP); Takahiro Shinkai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 103 days.

(21) Appl. No.: 13/661,044

(22) Filed: Oct. 26, 2012

(65) Prior Publication Data

US 2013/0133311 A1 May 30, 2013

(30) Foreign Application Priority Data

Nov. 25, 2011 (JP) ..... 2011-256961

(51) Int. Cl.

| | |
|---|---|
| ***F01N 3/00*** | (2006.01) |
| ***F01N 3/02*** | (2006.01) |
| ***F01N 3/10*** | (2006.01) |
| ***F01N 3/20*** | (2006.01) |
| ***F01N 13/00*** | (2010.01) |
| ***F01N 13/10*** | (2010.01) |

(52) U.S. Cl.

CPC ..... *F01N 13/008* (2013.01); *F01N 13/10* (2013.01); *F01N 13/107* (2013.01)

(58) Field of Classification Search

USPC ..... 60/323, 324

See application file for complete search history.

(56) References Cited

U.S. PATENT DOCUMENTS

| | | | |
|---|---|---|---|
| 5,929,397 | A | 7/1999 | Satoh et al. |
| 2007/0125067 | A1 | 6/2007 | I et al. |

FOREIGN PATENT DOCUMENTS

| | | | |
|---|---|---|---|
| CN | 1208120 | | 2/1999 |
| CN | 1978873 | | 6/2007 |
| JP | 09-291818 | | 11/1997 |
| JP | 2007-211663 | * | 8/2007 |
| JP | 2009-281333 | | 12/2009 |
| JP | 2010-001869 | | 1/2010 |
| JP | 2011-208586 | | 10/2011 |

OTHER PUBLICATIONS

Machine translation JP 2007-211663. Done Jun. 19, 2014.*

Chinese Office Action for corresponding CN Application No. 201210400952.3, Jul. 3, 2014.

Japanese Office Action for corresponding JP Application No. 2011-256961, Dec. 16, 2014.

* cited by examiner

*Primary Examiner* — Audrey K Bradley

*Assistant Examiner* — Dapinder Singh

(74) *Attorney, Agent, or Firm* — Mori & Ward, LLP

(57) ABSTRACT

An exhaust apparatus for an internal combustion engine includes a first exhaust collecting section, a first exhaust passage, a first exhaust sensor, and a rib. The first exhaust passage is connected to the first exhaust collecting section and has a curved shape to change a flow direction of the exhaust gas from a direction in which the exhaust gas is ejected from each of first cylinders. The first exhaust passage includes an outer wall provided on a radially outer side of the curved shape. The rib is provided on the outer wall of the first exhaust passage and extends along a direction perpendicular to a direction in which the exhaust gas flows. The rib is positioned downstream from the first exhaust sensor.

6 Claims, 8 Drawing Sheets

#4

#5

#6

EXHAUST APPARATUS FOR INTERNAL COMBUSTION ENGINE

CROSS-REFERENCE TO RELATED APPLICATIONS

The present application claims priority under 35 U.S.C. §119 to Japanese Patent Application No. 2011-256961, filed Nov. 25, 2011, entitled "Exhaust Apparatus For Internal Combustion Engine." The contents of this application are incorporated herein by reference in their entirety.

BACKGROUND OF THE INVENTION

1. Field of the Invention

The present disclosure relates to an exhaust apparatus for an internal combustion engine.

2. Discussion of the Background

In a typical exhaust system for an internal combustion engine, an exhaust sensor for detecting the composition of exhaust gas ejected from a plurality of cylinders is arranged in a cone section through which the exhaust gas between an exhaust manifold in which the exhaust gases from the cylinders are collected and a close coupled catalytic converter immediately downstream of the engine.

The exhaust sensor protrudes in the cone section and is arranged in a location where all of exhaust flows from the cylinders uniformly comes into contact with the detecting section to detect the composition of all the exhaust gases from the cylinders (see Japanese Unexamined Patent Application Publication No. 2010-001869).

SUMMARY OF THE INVENTION

According to one aspect of the present invention, an exhaust apparatus for an internal combustion engine includes a first exhaust collecting section, a first exhaust passage, a first exhaust sensor, and a rib. The first exhaust collecting section includes first exhaust ports extending from a plurality of first cylinders in the internal combustion engine. The first exhaust ports are combined to collect exhaust gas ejected from the plurality of first cylinders. The exhaust gas from the exhaust collecting section is to flow through the first exhaust passage. The first exhaust passage is connected to the first exhaust collecting section and has a curved shape to change a flow direction of the exhaust gas from a direction in which the exhaust gas is ejected from each of the first cylinders. The first exhaust passage includes an outer wall provided on a radially outer side of the curved shape. The first exhaust sensor is disposed on the outer wall of the first exhaust passage and includes a first detector configured to detect a constituent of the exhaust gas. The first detector protrudes from the outer wall of the first exhaust passage into an inside of the first exhaust passage. The rib is provided on the outer wall of the first exhaust passage and extending along a direction perpendicular to a direction in which the exhaust gas is to flow. The rib is positioned downstream from the first exhaust sensor.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

FIG. 7A is a cross-sectional view thereof, and FIG. 7B is a frontal view thereof.

DESCRIPTION OF THE EMBODIMENTS

Figure 1:
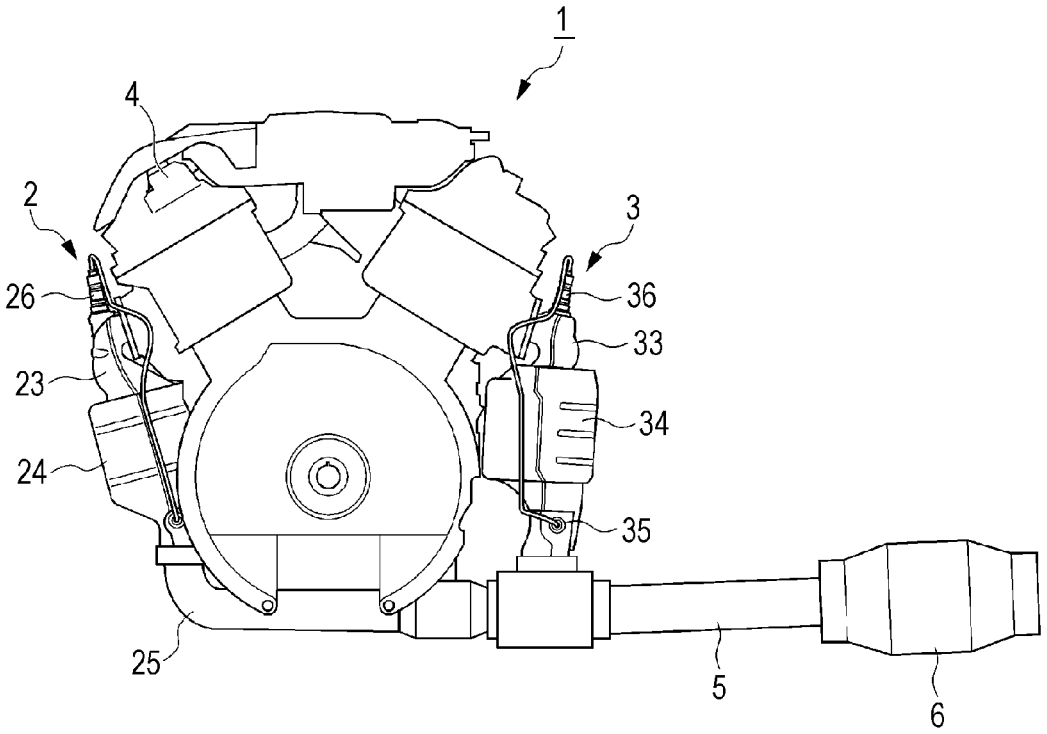
FIG. 1 is a side view that illustrates in general an internal combustion engine according to an embodiment.

The embodiments will now be described with reference to the accompanying drawings, wherein like reference numerals designate corresponding or identical elements throughout the various drawings.

FIG. 1 illustrates in general an internal combustion engine 1 according to the present embodiment. The internal combustion engine 1 illustrated in FIG. 1 is a transverse V6 engine. The six cylinders are arranged such that three cylinders are positioned on the front side and the other three cylinders are positioned on the rear side in the vehicle, an FR bank (front bank) 2 is disposed on the front side in the vehicle, and an RR bank (rear bank) 3 is disposed on the rear side.

An intake air is introduced from an intake system communicating with the portion directly above the internal combustion engine 1 to the cylinders of both the banks 2 and 3 in an engine main body 4. The intake air introduced from the intake passage into each cylinder is subjected to injection of a fuel supplied through a fuel injection valve, and they results in a mixed gas. The mixed gas burns in each cylinder, and this burning causes the piston to reciprocate and rotates the crankshaft. The exhaust gas after the burning in each cylinder is ejected to the exhaust system.

The exhaust system in the internal combustion engine is made up of two exhaust systems of one in the FR bank 2 and the other in the RR bank 3 for the engine main body 4, and the two exhaust systems are combined downstream.

Figure 2:
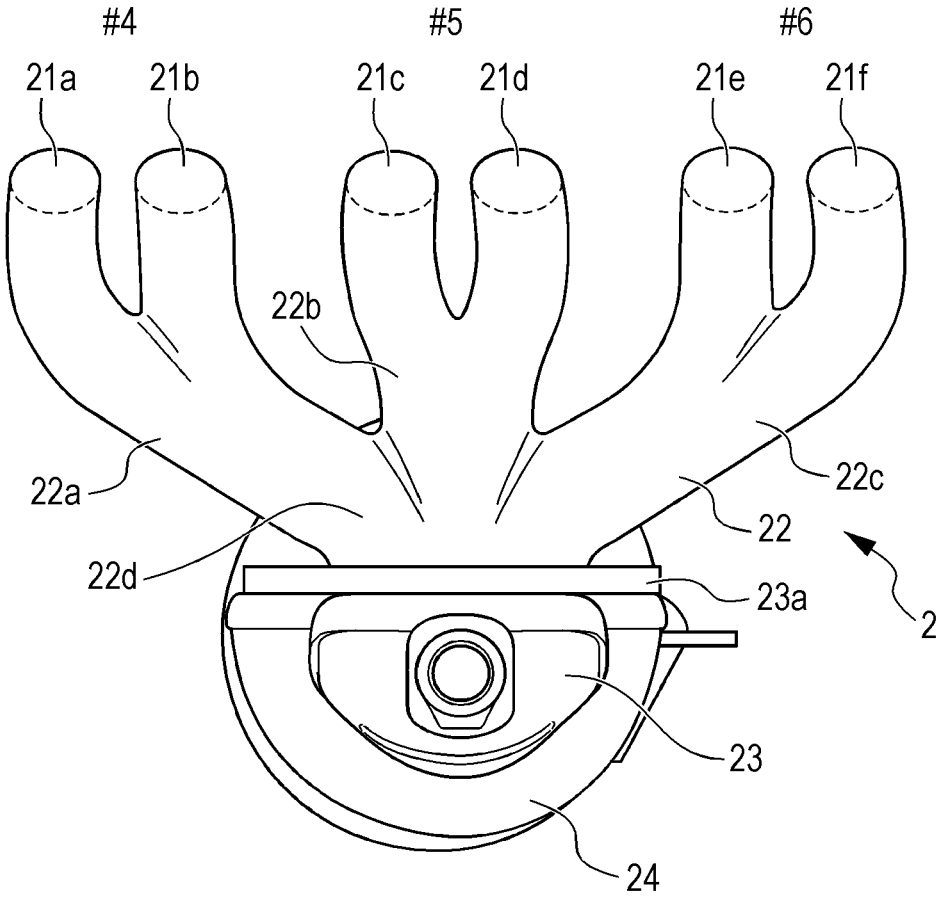
FIG. 2 is a top view that illustrates an exhaust system in an FR bank according to the embodiment.

FIG. 2 is a top view that illustrates the exhaust system in the FR bank 2 according to the present embodiment.

The exhaust system in the FR bank 2 includes exhaust ports 21*a* to 21*f*, an exhaust manifold 22 as an exhaust collecting section, a cone section 23 as an exhaust passage, a close coupled catalytic converter 24 immediately downstream of the engine, and an FR bank-side exhaust pipe 25 (see FIG. 1).

As illustrated in FIG. 2, the exhaust ports 21*a* to 21*f* in the FR bank 2 extend in groups of two from the cylinders with the numbers 4 to 6 (hereinafter referred to as cylinders #4 to #6) in the FR bank 2 toward the front of the vehicle.

The exhaust manifold 22 in the FR bank 2 combines the exhaust ports 21*a* to 21*f* on the front side of the vehicle and collects the exhaust gases from the cylinders #4 to #6 in the FR bank 2.

As illustrated in FIG. 2, the exhaust manifold 22 combines the two exhaust ports 21*a* and 21*b* extending from the cylinder #4 into a branch 22*a*, the two exhaust ports 21*c* and 21*d* extending from the cylinder #5 into a branch 22*b*, and the two exhaust ports 21*e* and 21*f* extending from the cylinder #6 into a branch 22*c*. The exhaust manifold 22 combines the branches 22*a*, 22*b*, and 22*c* corresponding to the cylinders #4 to #6 in a downstream location and collects the exhaust gases in a collecting section 22*d*.

The exhaust manifold 22 is connected to the cone section 23 in the FR bank 2. The cone section 23 is curved so as to change its direction with respect to the direction in which the exhaust gases are ejected from the cylinders #4 to #6 and allows the exhaust gas from the exhaust manifold 22 to flow downstream.

As illustrated in FIG. 2, the cone section 23 is joined to the exhaust manifold 22 with a flange section 23*a* in a surface contact manner.

Figure 4:
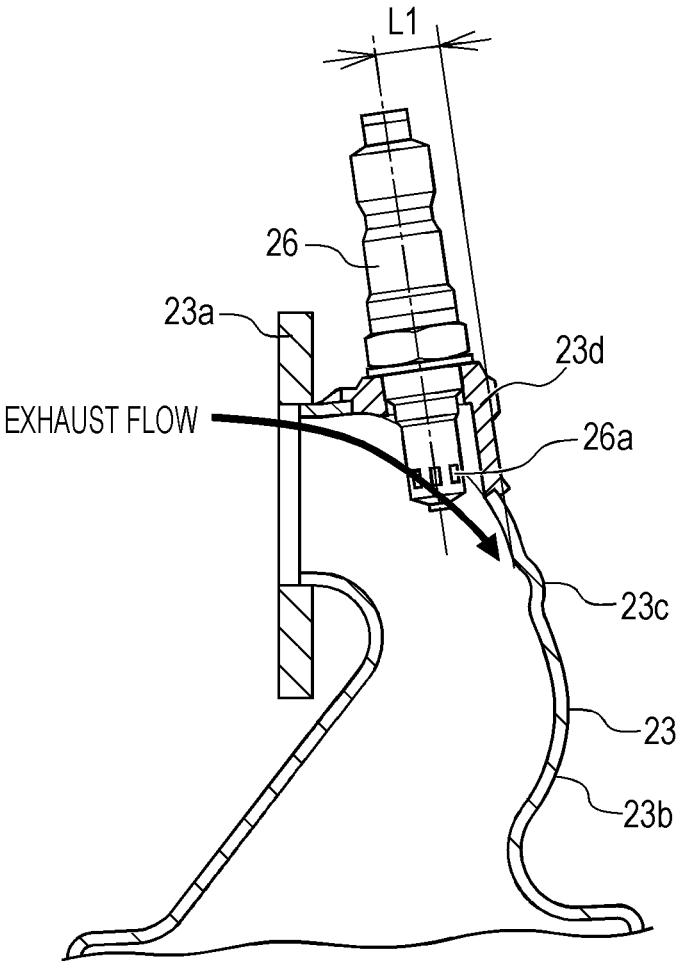
FIG. 4 is a cross-sectional view that illustrates a cone section and a LAF sensor in the FR bank according to the embodiment.

A linear air-fuel ratio (LAF) sensor 26 is arranged in the cone section 23 (see FIGS. 1, 4, and 6). The LAF sensor 26 outputs a current value proportional to an air-fuel ratio on the basis of, for example, the amount of oxygen ions passing through a zirconia solid electrolyte to an engine control unit (ECU) and detects a constituent of the exhaust gas.

The LAF sensor 26 is arranged in an extension line in the direction in which the exhaust gases are ejected from the cylinders #4 to #6 when viewed from a horizontal plane. That is, from the exhaust ports 21*a* to 21*f* of the cylinders #4 to #6 through the collecting section 22*d* to a detecting section 26*a* (see FIG. 4) of the LAF sensor 26 are arranged in a line when viewed from a horizontal plane, and the exhaust gases flow toward the detecting section 26*a* of the LAF sensor 26 in a straight-line manner.

The close coupled catalytic converter 24 in the FR bank 2 is a three-way catalytic converter that cleans the exhaust flowing from the cone section 23 of noxious substances by oxidation and reduction. The close coupled catalytic converter 24 may include one in which platinum, palladium, rhodium or the like is attached to the surface of a porous ceramic cylinder through which the exhaust passes using activated alumina as the base. The close coupled catalytic converter 24 is housed in a protective case made of a heat resisting steel plate.

The close coupled catalytic converter 24 is connected to the FR bank-side exhaust pipe 25. The FR bank-side exhaust pipe 25 meets an RR bank-side exhaust pipe 35 extending in the rear of the vehicle described below in a downstream location and communicates with a collective exhaust pipe 5.

Figure 3:
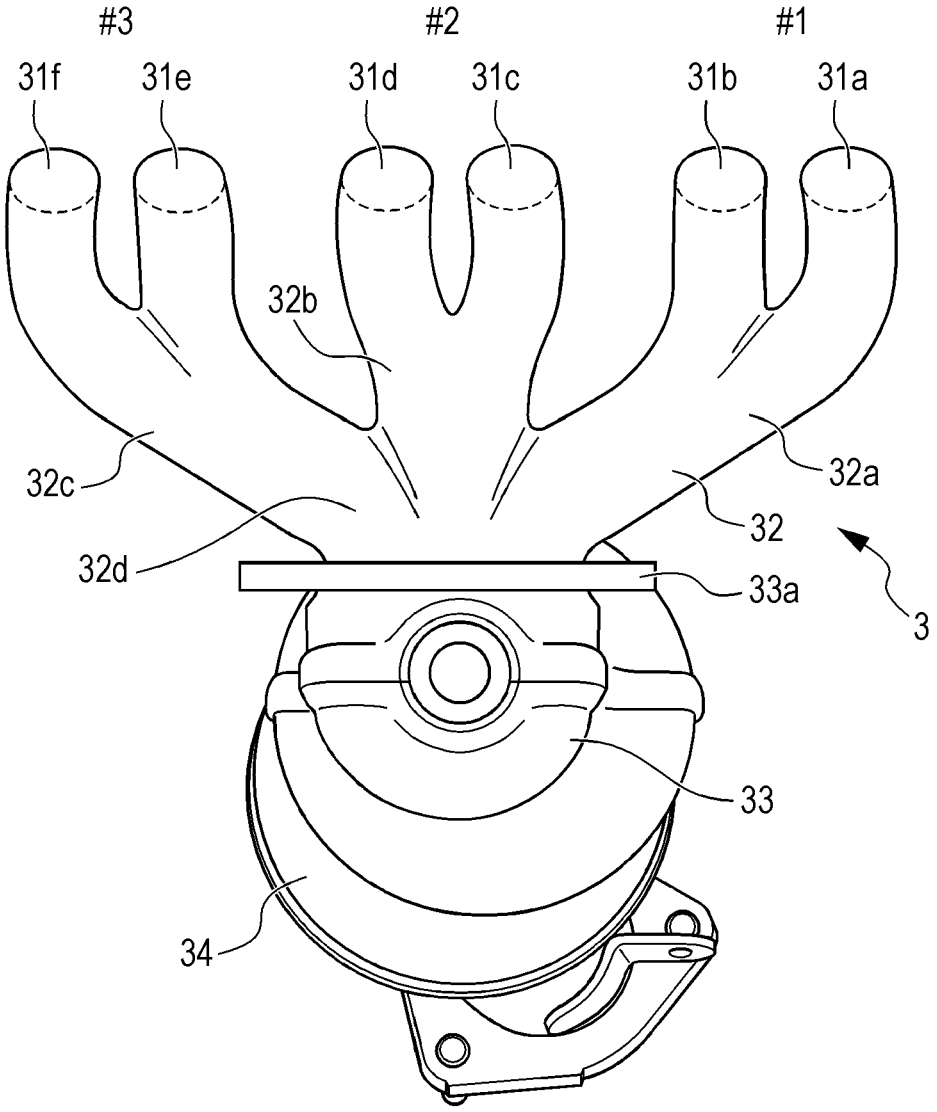
FIG. 3 is a top view that illustrates an exhaust system in an RR bank according to the embodiment.

FIG. 3 is a top view of the exhaust system in the RR bank 3.

The exhaust system in the RR bank 3 includes exhaust ports 31*a* to 31*f*, an exhaust manifold 32 as an exhaust collecting section, a cone section 33 as an exhaust passage, a close coupled catalytic converter 34 immediately downstream of the engine, and the RR bank-side exhaust pipe 35 (see FIG. 1).

As illustrated in FIG. 3, the exhaust ports 31*a* to 31*f* in the RR bank 3 extend in groups of two from the cylinders with the numbers 1 to 3 (hereinafter referred to as cylinders #1 to #3) in the RR bank 3 toward the rear of the vehicle.

The exhaust manifold 32 in the RR bank 3 combines the exhaust ports 31*a* to 31*f* on the rear side of the vehicle and collects the exhaust gases from the cylinders #1 to #3 in the RR bank 3.

As illustrated in FIG. 3, the exhaust manifold 32 combines the two exhaust ports 31*a* and 31*b* extending from the cylinder #1 into a branch 32*a*, the two exhaust ports 31*c* and 31*d* extending from the cylinder #2 into a branch 32*b*, and the two exhaust ports 31*e* and 31*f* extending from the cylinder #3 into a branch 32*c*. The exhaust manifold 32 combines the branches 32*a*, 32*b*, and 32*c* corresponding to the cylinders #1 to #3 in a downstream location and collects the exhaust gases in a collecting section 32*d*.

The exhaust manifold 32 is connected to the cone section 33 in the RR bank 3. The cone section 33 is curved so as to change its direction with respect to the direction in which the exhaust gases are ejected from the cylinders #1 to #3 and allows the exhaust gas from the exhaust manifold 32 to flow downstream.

As illustrated in FIG. 3, the cone section 33 is joined to the exhaust manifold 32 with a flange section 33*a* in a surface contact manner.

Figure 5:
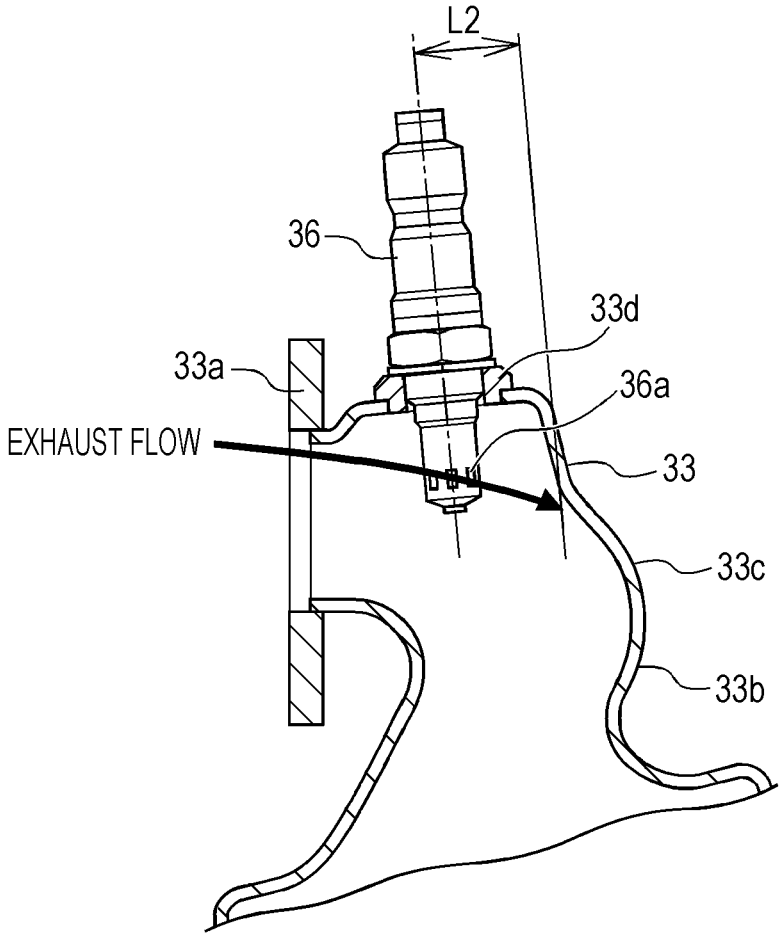
FIG. 5 is a cross-sectional view that illustrates a cone section and a LAF sensor in the RR bank according to the embodiment.

A LAF sensor 36 is arranged in the cone section 33 (see FIGS. 1 and 5). The LAF sensor 36 outputs a current value proportional to an air-fuel ratio on the basis of, for example, the amount of oxygen ions passing through a zirconia solid electrolyte to the ECU and detects a constituent of the exhaust gas.

The LAF sensor 36 is arranged in an extension line in the direction in which the exhaust gases are ejected from the cylinders #1 to #3 when viewed from a horizontal plane. That is, from the exhaust ports 31*a* to 31*f* of the cylinders #1 to #3 through the collecting section 32*d* to a detecting section 36*a* (see FIG. 5) of the LAF sensor 36 are arranged in a line when viewed from a horizontal plane, and the exhaust gases flow toward the detecting section 36*a* of the LAF sensor 36 in a straight-line manner.

The close coupled catalytic converter 34 in the RR bank 3 is a three-way catalytic converter that cleans the exhaust flowing from the cone section 33 of noxious substances by oxidation and reduction. The close coupled catalytic converter 34 may include one in which platinum, palladium, rhodium or the like is attached to the surface of a porous ceramic cylinder through which the exhaust passes using activated alumina as the base. The close coupled catalytic converter 34 is housed in a protective case made of a heat resisting steel plate.

The close coupled catalytic converter 34 is connected to the RR bank-side exhaust pipe 35. The RR bank-side exhaust pipe 35 meets the FR bank-side exhaust pipe 25 extending from the front of the vehicle in a downstream location and communicates with the collective exhaust pipe 5.

As illustrated in FIG. 1, the collective exhaust pipe 5 is connected to an underfloor catalytic converter 6 in a downstream location. The catalyst of the same kind as in the close coupled catalytic converters 24 and 34 can be used in the close coupled catalytic converter 6.

The cone section 23 in the FR bank 2 is described below with reference to FIG. 4. FIG. 4 is a cross-sectional view that illustrates the cone section 23 and the LAF sensor 26 in the FR bank 2.

The cone section 23 in the FR bank 2 is joined to the exhaust manifold 22 with the flange section 23*a* in a surface contact manner, is curved so as to change its direction downward in FIG. 4 with respect to the direction in which the exhaust gases are ejected from the cylinders #4 to #6 (horizontal direction in FIG. 4), and allows the exhaust gases to flow into the close coupled catalytic converter 24. The cone section 23 has a flared skirt shape that gradually increases its diameter downstream from the curve because the downstream close coupled catalytic converter 24 has a large diameter.

The LAF sensor 26 is arranged in the cone section 23 in the FR bank 2 along an extension line in the direction in which the exhaust gases are ejected from the cylinders #4 to #6 when viewed from a horizontal plane. Because the cone section 23 is curved and changes the direction of the exhaust flow, the LAF sensor 26 is disposed on an outer wall 23*b* of the cone section 23 remote from the exhaust manifold 22, and the detecting section 26*a* for detecting a constituent of the exhaust gases protrudes inside the cone section 23 in a location where the downwardly turning exhaust gases from the cylinders #4 to #6 come into direct contact with the detecting section 26*a*.

Because the outer wall 23*b* of the cone section 23 is a curved surface, the LAF sensor 26 is fixed to the cone section 23 with a support 23*d* having an L shape in cross section, the support 23*d* enabling the LAF sensor 26 to be inserted from the above.

In the cone section 23 in the FR bank 2, a rib 23*c* extending on the outer wall 23*b* in a straight line in the direction perpendicular to the direction of the exhaust flow (in a horizontal direction in FIG. 4) and positioned downstream from the LAF sensor 26 is disposed.

The cone section 33 in the RR bank 3 is described below with reference to FIG. 5. FIG. 5 is a cross-sectional view that illustrates the cone section 33 and the LAF sensor 36 in the RR bank 3.

The cone section 33 in the RR bank 3 is joined to the exhaust manifold 32 with the flange section 33*a* in a surface contact manner, is curved so as to change its direction downward in FIG. 5 with respect to the direction in which the exhaust gases are ejected from the cylinders #1 to #3 (horizontal direction in FIG. 5), and allows the exhaust gases to flow into the close coupled catalytic converter 34. The cone section 33 has a flared skirt shape that gradually increases its diameter downstream from the curve because the downstream close coupled catalytic converter 34 has a large diameter.

The LAF sensor 36 is arranged in the cone section 33 in the RR bank 3 along an extension line in the direction in which the exhaust gases are ejected from the cylinders #1 to #3 when viewed from a horizontal plane. Because the cone section 33 is curved and changes the direction of the exhaust flow, the LAF sensor 36 is disposed on an outer wall 33*b* of the cone section 33 remote from the exhaust manifold 32, and the detecting section 36*a* for detecting a constituent of the exhaust gases protrudes inside the cone section 33 in a location where the downwardly turning exhaust gases from the cylinders #1 to #3 come into direct contact with the detecting section 36*a*.

Because the outer wall 33*b* of the cone section 33 has an upper surface, the LAF sensor 36 is inserted from the above and fixed with a support 33*d*.

Because the cone section 33 in the RR bank 3 on the rear side of the vehicle has empty space and the layout has ample room, the distance L2 between the detecting section 36*a* of the LAF sensor 36 and the outer wall 33*b* with which the exhaust gas having passed through the detecting section 36*a* collides in the cone section 33 in the RR bank on the rear side of the vehicle is increased.

That is, the distance L2 for the cone section 33 in the RR bank 3 on the rear side of the vehicle is longer than the distance L1 (see FIG. 4) between the detecting section 26*a* of the LAF sensor 26 and the outer wall 23*b* with which the exhaust gas having passed through the detecting section 26*a* collides in the cone section 23 in the FR bank 2 on the front side of the vehicle. That is, the relation L2>L1 is established. Thus, in the cone section 33, where the distance L2 is set, the momentum of the exhaust gas colliding with the outer wall 33*b* is weakened, and the stress occurring in the collision is reduced.

The cone section 33 in the RR bank 3 does not include an outer wall that has a rib, unlike the cone section 23 in the FR bank 2 including the outer wall having the rib 23*c*. The outer wall 33*b* of the cone section 33 in the RR bank 3 with which the exhaust gas having passed through the detecting section 36*a* of the LAF sensor 36 collides has a large rounded shape 33*c*. In the cone section 33, which includes the outer wall 33*b* with the large rounded shape 33*c*, the momentum of the exhaust gas colliding with the outer wall 33*b* is weakened, and the stress occurring in the collision is reduced.

In contrast to the cone section 33 in the RR bank 3, in which the longer distance L2 is set and the outer wall 33*b* has the large rounded shape 33*c*, the cone section 23 in the FR bank 2 has the shorter distance L1 between the detecting section 26*a* of the LAF sensor 26 and the outer wall 23*b* with which the exhaust gas having passed through the detecting section 26*a* collides and has a great momentum of the exhaust gas colliding with the outer wall 23*b*.

Figure 6A:
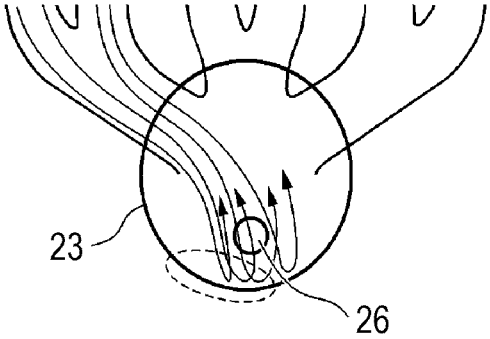
FIGS. 6A to 6C illustrate exhaust flows from exhaust ports into the cone section in the FR bank according to the embodiment.
Figure 6B:
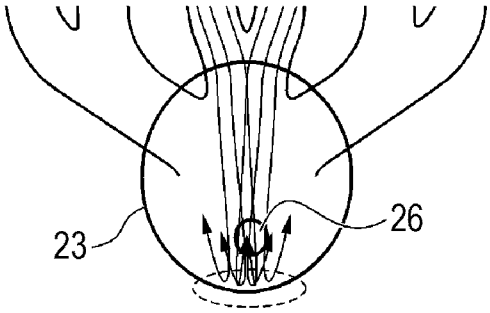
Figure 6C:
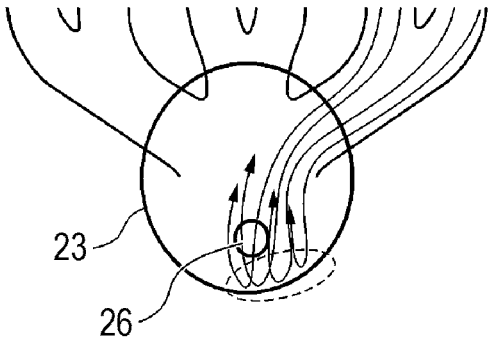

In addition, the exhaust gases ejected from the cylinders #4 to #6 collide with the outer wall 23*b* in different locations. FIGS. 6A to 6C illustrate exhaust flows from the exhaust ports 21*a* to 21*f* of the cylinders #4 to #6 into the cone section 23 in the FR bank according to the present embodiment. The locations where the exhaust gases flowing toward the detecting section 26*a* of the LAF sensor 26 in a straight-line manner collide with the outer wall 23*b* differ among the cylinders #4 to #6 in the location perpendicular to the direction of the exhaust flow, as illustrated in the regions indicated by the broken lines in FIGS. 6A to 6C. The locations of the collisions of the exhaust flow with the outer wall 23*b* in the height direction do not differ among the cylinders #4 to #6, as illustrated in the arrows indicating the exhaust flows. Accordingly, the locations of the collisions of the exhaust gases from the cylinders #4 to #6 with the outer wall 23*b* are arranged in a line perpendicular to the direction of the exhaust flow.

In the present embodiment, the rib 23*c* extending on the outer wall 23*b* of the cone section 23 in the FR bank 2 in the locations of the collisions of the exhaust gases from the cylinders #4 to #6 in the direction perpendicular to the direction of the exhaust flow (horizontal direction in FIGS. 6A to 6C) in a straight line and positioned downstream from the LAF sensor 26 is disposed.

Figure 7A:
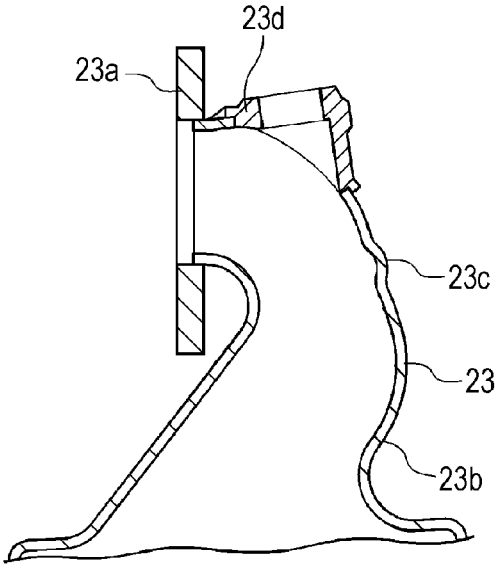
FIGS. 7A and 7B illustrate the cone section in the FR bank according to the embodiment.
Figure 7B:
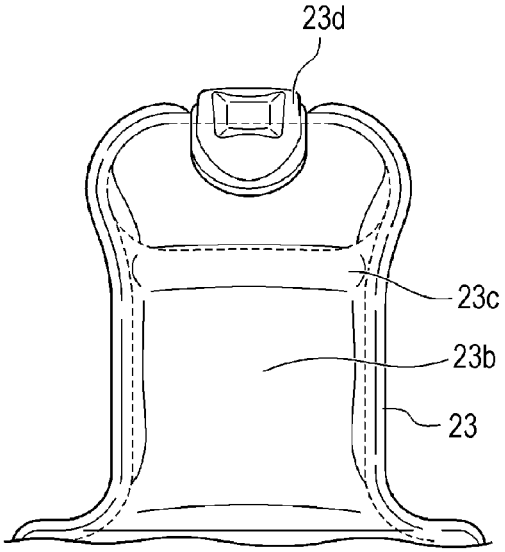

FIGS. 7A and 7B illustrate the cone section 23 in the FR bank 2 according to the above-described present embodiment, FIG. 7A is a cross-sectional view thereof, and FIG. 7B is a frontal view thereof.

The single rib 23*c* is formed such that the outer wall 23*b* with which the exhaust gas having passed through the detecting section 26*a* of the LAF sensor 26 collides with protrudes outward, as illustrated in FIG. 7A, and the rib 23*c* extends over the wide outer wall 23*b* in a straight line in the direction perpendicular to the direction of the exhaust flow (horizontal direction in FIGS. 7A and 7B), as illustrated in FIG. 7B.

The shape of the external protrusion of the rib 23*c* on the outer wall 23*b* is set at an arc shape having a predetermined radius of curvature at which the optimum balance between increasing the stiffness of the outer wall 23*b* and not interfering with the exhaust flow inside the cone section 23 is achieved.

Because the stiffness of the outer wall 23*b* in the location of collision of an exhaust gas is increased by the rib 23*c*, the stress occurring when the exhaust gases from the cylinders #4 to #6 collide in different locations in the direction perpendicular to the direction of the exhaust flow (horizontal direction in the drawings) can be reduced by the use of the rib 23*c*. Because the rib 23*c* is disposed such that the outer wall 23*b* protrudes outward, the rib 23*c* is not an obstacle to the exhaust flow inside the cone section 23. In addition, because only the single rib 23*c* is disposed, an increase in interference with the exhaust flow inside the cone section 23 that would be caused by multiple ribs does not occur.

Figure 8:
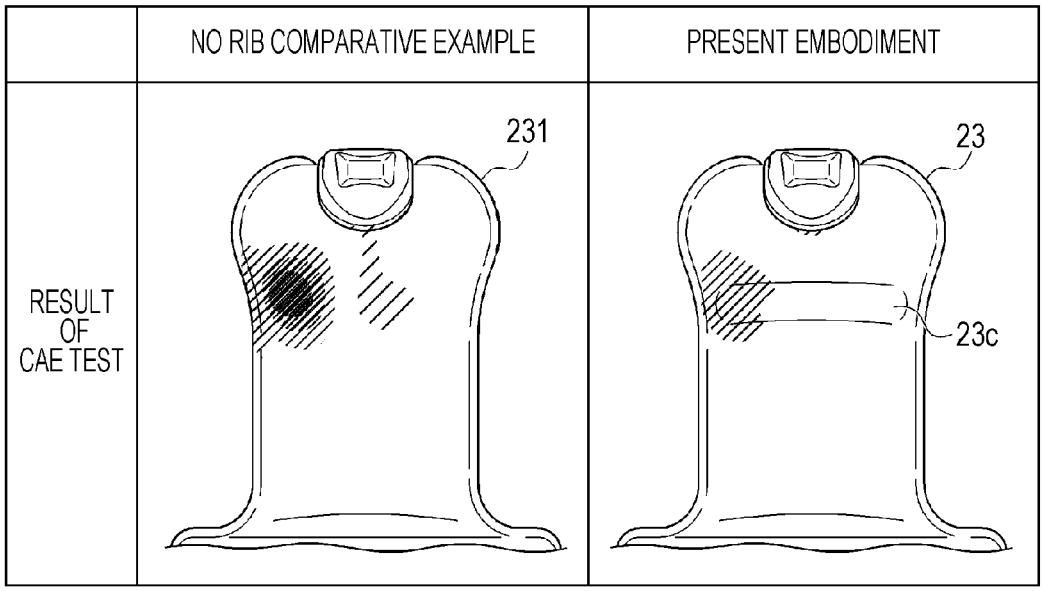
FIG. 8 illustrates results of a CAE test for a stress in the cone section in the FR bank according to the embodiment and for that in a cone section that includes no rib according to a comparative example.
Figure 9:
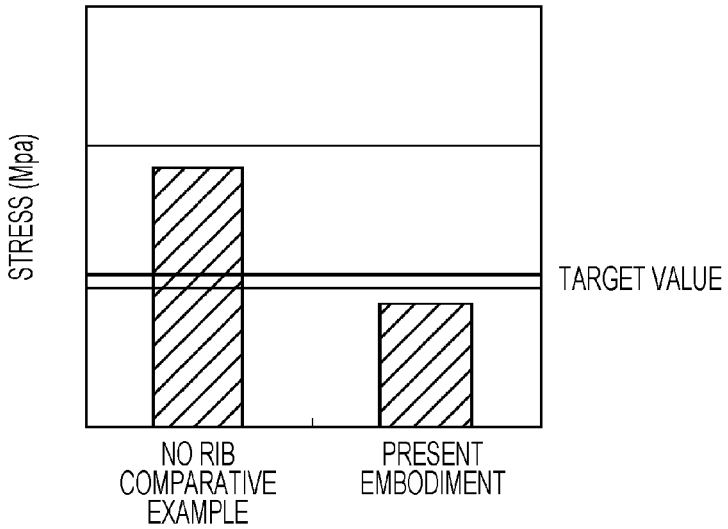
FIG. 9 illustrates in graphs the results of the CAE test for the stress in the cone section in the FR bank according to the embodiment and for that in the cone section including no rib according to the comparative example.

The inventors conducted a test for checking the advantageous effect of reducing a stress by the use of the rib 23*c*. FIG. 8 illustrates results of a CAE test for a stress in the cone section 23 in the FR bank 2 according to the present embodiment and for that in a cone section 231 that does not include the rib 23*c* according to a comparative example. FIG. 9 illustrates in graphs the results of the CAE test for the stress in the cone section 23 in the FR bank 2 according to the present embodiment and for that in the cone section 231 not including the rib 23*c* according to the comparative example.

Conditions of the test: An exhaust gas was ejected from the cylinder #4, and the stress occurring in the outer wall of the cone section 23 in the FR bank 2 and that of the cone section 231 at that time were measured.

Results: As illustrated in FIG. 8, a stress occurred in the left portion in the outer wall illustrated in FIGS. 8A and 8B in each of the cone section 23 in the FR bank 2 according to the present embodiment and the cone section 231 including no rib 23*c*. The results are based on ejection of the exhaust gas from the cylinder #4; if an exhaust gas is ejected from the cylinder #5 or #6, a stress occurs in a central portion or a right portion in the outer wall illustrated in FIGS. 8A and 8B in the same height location.

The location where the stress occurred in the cone section 23 in the FR bank 2 according to the present embodiment was in the rib 23*c* and its vicinity.

As illustrated in FIG. 9, in the cone section 23 in the FR bank 2 according to the present embodiment, the occurring stress was below a target value. In contrast, in the cone section 231 including no rib 23*c* according to the comparative example, the occurring stress exceeded the target value. Thus, the advantageous effect of reducing the stress by the use of the rib 23*c* was confirmed. The target value is set such that the stress occurring in the cone section 33, in which no noise occur, in the RR bank 3, is used as the reference.

With the internal combustion engine according to the present embodiment, the following advantageous effects can be provided.

(1) The rib 23*c* extends on the outer wall 23*b* in the direction perpendicular to the direction of the exhaust flow, and the stiffness of the outer wall 23*b* is increased. Thus, a stress occurring when the exhaust gases ejected from the cylinders #4 to #6 and having passed through the detecting section 26*a* of the LAF sensor 26 collide with the outer wall 23*b* of the cone section 23 in different locations in the direction perpendicular to the direction of the exhaust flow can be reduced by the use of the rib 23*c*, and noise resulting from the stress can be reduced, and the silencing can be improved.

Unlike in the present embodiment, arrangement of a rib extending along the direction of the exhaust flow can be another approach. However, the arrangement of the rib extending along the direction of the exhaust flow is not efficient because the exhaust gases from the cylinders collide with the outer wall of the cone section in different locations in the direction perpendicular to the direction of the exhaust flow and the locations of the collisions are arranged in a line perpendicular to the direction of the exhaust flow.

(2) Because the rib 23*c* is disposed in a location where the exhaust gas having passed through the detecting section 26*a* of the LAF sensor 26 collides with the outer wall and the stiffness of the outer wall 23*b* in that location of the collision is increased, a stress occurring when the exhaust gases collide in different locations in the direction perpendicular to the direction of the exhaust flow can be reduced by the use of the rib 23*c*, noise resulting from the stress can be reduced, and the silencing can be improved.

Because the rib 23*c* is formed such that the outer wall 23*b* protrudes outward, the rib 23*c* is not an obstacle to the exhaust flow inside the cone section 23 and does not interfere with the exhaust flow, and the exhaust flow is not blocked.

Because only the single rib 23*c* is disposed, an increase in interference with the exhaust flow inside the cone section including the rib that would be caused by multiple ribs does not occur.

(3) Because the exhaust gases flow toward the detecting sections 26*a* and 36*a* of the LAF sensors 26 and 36 in a straight-line manner, the exhaust gases from the cylinders can flow in the detecting sections 26*a* and 36*a* with reliability, and uniform detection among the cylinders can be achieved.

The locations of collisions of the exhaust gases having flowed in a straight-line manner toward the detecting section 26*a* of the LAF sensor 26 on the outer wall 23*b* are arranged in a line perpendicular to the direction of the exhaust flow. Thus, a stress occurring when the exhaust gases ejected from the cylinders #4 to #6 and having passed through the detecting section 26*a* of the LAF sensor 26 collide with the outer wall 23*b* of the cone section 23 in different locations on a line in the direction perpendicular to the direction of the exhaust flow can be reduced by the use of the rib 23*c*, noise resulting from the stress can be reduced, and the silencing can be improved.

(4) In the FR bank 2 on the front side of the vehicle, a stress occurring when the exhaust gases ejected from the cylinders #4 to #6 and having passed through the detecting section 26*a* of the LAF sensor 26 collide with the outer wall 23*b* of the cone section 23 in different locations in the direction perpendicular to the direction of the exhaust flow can be reduced by the use of the rib 23*c*, and noise resulting from the stress can be reduced, and the silencing can be improved.

In the RR bank 3 on the rear side of the vehicle, because empty space is present and the layout has ample room, the distance between the detecting section 36*a* of the LAF sensor 36 and the outer wall 33*b* with which the exhaust gas collides in the cone section 33 can be increased, and the outer wall 33*b* can have the large rounded shape 33*c* by which the exhaust gas having passed through the LAF sensor 36 can be prevented from strongly colliding with the outer wall. Thus, the silencing can be improved.

Accordingly, the silencing can be optimally improved on the front and rear sides of the vehicle.

(5) Because the RR bank 3 on the rear side of the vehicle has empty space and the layout has ample room, the distance L2 between the detecting section 36*a* of the LAF sensor 36 and the outer wall 33*b* with which the exhaust gas having passed through the detecting section 36*a* collides in the cone section 33 in the RR bank 3 on the rear side of the vehicle can be increased. Thus, the exhaust gas having passed through the LAF sensor 36 does not strongly collide with the outer wall 33*b*, the occurrence of noise can be suppressed, and the silencing can be improved. The rib is not required to be disposed on the outer wall 33*b* of the cone section 33.

The present application is not limited to the above-described embodiment. Various modifications and improvements within the scope of the present application are also included in the present application.

In the present embodiment, a LAF sensor is used as an exhaust sensor. Alternatively, an oxygen sensor that detects the concentration of oxygen in gas may also be used.

(A) An exhaust apparatus for an internal combustion according to an aspect of the embodiment includes an exhaust collecting section (e.g., exhaust manifold 22) in which exhaust ports (e.g., exhaust ports 21*a* to 21*f*) extending from a plurality of cylinders in the internal combustion engine (e.g., internal combustion engine 1) are combined and exhaust gases ejected from the plurality of cylinders are collected, an exhaust passage (e.g., cone section 23) connected to the exhaust collecting section, being curved so as to change its direction with respect to a direction in which the exhaust gas is ejected from each of the cylinders, and allowing the exhaust gas from the exhaust collecting section to flow downstream, an exhaust sensor (e.g., LAF sensor 26) disposed on an outer wall (e.g., outer wall 23*b*) remote from the exhaust collecting section in the exhaust passage and including a detecting section (e.g., detecting section 26*a*) that protrudes in the exhaust passage and that detects a constituent of the exhaust gas, and a rib (e.g., rib 23*c*) extending on the outer wall of the exhaust passage in a direction perpendicular to a direction in which the exhaust gas flows and positioned downstream from the exhaust sensor.

With the exhaust apparatus according to the aspect (A) of the embodiment, because the rib extends on the outer wall in the direction perpendicular to the direction of the exhaust flow and the stiffness of the outer wall is increased, a stress occurring when the exhaust gases ejected from the cylinders and having passed through the detecting section of the exhaust sensor collide with the outer wall of the exhaust passage in different locations in the direction perpendicular to the direction of the exhaust flow can be reduced by the use of the rib, and noise resulting from the stress can be reduced, and the silencing can be improved.

Unlike in the exhaust apparatus described in the aspect (A) of the embodiment, arrangement of a rib extending along the direction of the exhaust flow can be another approach. However, the arrangement of the rib extending along the direction of the exhaust flow is not efficient because the exhaust gases from the cylinders collide with the outer wall of the exhaust passage in different locations in the direction perpendicular to the direction of the exhaust flow and the locations of the collisions are arranged in a line perpendicular to the direction of the exhaust flow.

(B) In the exhaust apparatus for the internal combustion engine described in the aspect (A) of the embodiment, the rib of the embodiment may be a single rib formed such that the outer wall in a location where the exhaust gas having passed through the detecting section of the exhaust sensor collides with the outer wall protrudes outward.

With the exhaust apparatus according to the aspect (B) of the embodiment, because the rib is disposed in a location where the exhaust gas having passed through the detecting section of the exhaust sensor collides with the outer wall and the stiffness of the outer wall in that location of the collision is increased, a stress occurring when the exhaust gases collide in different locations in the direction perpendicular to the direction of the exhaust flow can be reduced by the use of the rib, noise resulting from the stress can be reduced, and the silencing can be improved.

Because the rib of the embodiment is formed such that the outer wall protrudes outward, the rib is not an obstacle to the exhaust flow inside the exhaust passage and does not block the exhaust flow.

Because only the single rib is disposed, an increase that would be caused by multiple ribs in interference with the exhaust flow inside the exhaust passage on which the ribs are disposed does not occur, and the exhaust flow is not blocked thereby.

(C) In the exhaust apparatus for the internal combustion engine described in the aspect (A) or (B) of the embodiment, the exhaust gases of the embodiment may flow from the exhaust ports extending from the plurality of cylinders toward the detecting section of the exhaust sensor in a straight-line manner.

With the exhaust apparatus according to the aspect (C), because the exhaust gases flow toward the detecting section of the exhaust sensor in a straight-line manner, the exhaust gases from the cylinders can flow in the detecting section with reliability, and uniform detection among the cylinders can be achieved.

The locations of the collisions of the exhaust gases having flowed in a straight-line manner toward the detecting section of the exhaust sensor on the outer wall are arranged in a line perpendicular to the direction of the exhaust flow. Thus, a stress occurring when the exhaust gases ejected from the cylinders and having passed through the detecting section of the exhaust sensor collide with the outer wall of the exhaust passage in different locations on a line in the direction perpendicular to the direction of the exhaust flow can be reduced by the use of the rib, noise resulting from the stress can be reduced, and the silencing can be improved.

(D) In the exhaust apparatus for the internal combustion engine described in any one of the aspects (A) to (C) of the embodiment, the internal combustion engine may be a transverse V engine, the exhaust passage in a front bank (e.g., FR bank 2) on a front side of the vehicle may include the outer wall on which the rib is disposed, and the exhaust passage in a rear bank (e.g., RR bank 3) on a rear side of the vehicle may not include the outer wall on which the rib is disposed.

With the exhaust apparatus according to the aspect (D) of the embodiment, in the front bank on the front side of the vehicle, a stress occurring when the exhaust gases ejected from the cylinders and having passed through the detecting section of the exhaust sensor collide with the outer wall of the exhaust passage in different locations in the direction perpendicular to the direction of the exhaust flow can be reduced by the use of the rib, and noise resulting from the stress can be reduced, and the silencing can be improved.

In the rear bank on the rear side of the vehicle of the embodiment, because empty space is present and the layout has ample room, the distance between the detecting section of the exhaust sensor and the outer wall with which the exhaust gas in the exhaust passage collides can be increased, and the outer wall can have the large rounded shape by which the exhaust gas having passed through the exhaust sensor can be prevented from strongly colliding with the outer wall, and the silencing can be improved.

Accordingly, the silencing can be optimally improved on the front and rear sides of the vehicle.

(E) In the exhaust apparatus for the internal combustion engine described in the aspect (D) of the embodiment, a distance (e.g., distance L1) between the detecting section of the exhaust sensor and the outer wall with which the exhaust gas having passed through the detecting section collides in the exhaust passage in the front bank on the front side of the vehicle may be longer than that (e.g., distance L2) in the rear bank on the rear side of the vehicle.

With the exhaust apparatus according to the aspect (E) of the embodiment, because the rear bank on the rear side of the vehicle has empty space and the layout has ample room, the distance between the detecting section of the exhaust sensor and the outer wall with which the exhaust gas having passed through the detecting section collides in the exhaust passage in the rear bank on the rear side of the vehicle can be increased. Thus, the exhaust gas having passed through the exhaust sensor does not strongly collide with the outer wall, the occurrence of noise can be suppressed, and the silencing can be improved. The rib is not required to be disposed on the outer wall of the exhaust passage.

Obviously, numerous modifications and variations of the present invention are possible in light of the above teachings. It is therefore to be understood that within the scope of the appended claims, the invention may be practiced otherwise than as specifically described herein.

What is claimed is:

1. An exhaust apparatus for an internal combustion engine, the exhaust apparatus comprising:

a first exhaust collecting section including first exhaust ports extending from a plurality of first cylinders in the internal combustion engine, the first exhaust ports being combined to collect exhaust gas ejected from the plurality of first cylinders;

a first exhaust passage through which the exhaust gas from the exhaust collecting section is to flow, the first exhaust passage being connected to the first exhaust collecting section and having a curved shape to change a flow direction of the exhaust gas from a direction in which the exhaust gas is ejected from each of the first cylinders, the first exhaust passage including an outer wall provided on a radially outer side of the curved shape;

a first exhaust sensor disposed on the outer wall of the first exhaust passage and including a first detector configured to detect a constituent of the exhaust gas, the first detector protruding from the outer wall of the first exhaust passage into an inside of the first exhaust passage; and a rib protruding outward from the outer wall of the first exhaust passage, the rib being positioned downstream from the first exhaust sensor, wherein the rib extends a first distance along the outer wall in a direction perpendicular to a direction in which the exhaust gas is to flow, the rib extends a second distance along the outer wall in the direction in which the exhaust gas is to flow, and the first distance is greater than the second distance.

2. The exhaust apparatus according to claim 1, wherein the outer wall includes a collision portion with which the exhaust gas having passed through the first detector of the first exhaust sensor collides, and wherein the rib comprises a single rib provided such that the collision portion of the outer wall protrudes outward.

3. The exhaust apparatus according to claim 1, wherein the first exhaust ports extend from the plurality of first cylinders toward the detecting portion of the first exhaust sensor to guide the exhaust gas substantially in a straight-line manner.

4. The exhaust apparatus according to claim 1, wherein the internal combustion engine comprises a transverse V-engine including a front bank provided on a front side in the vehicle, and a rear bank provided on a rear side in the vehicle, wherein the plurality of first cylinders are provided in the front bank of the transverse V-engine, and wherein the rib is provided only in the front bank.

5. The exhaust apparatus according to claim 4, further comprising:

a second exhaust collecting section including second exhaust ports extending from a plurality of second cylinders provided in the rear bank of the transverse V-engine, the second exhaust ports being combined to collect exhaust gas ejected from the plurality of second cylinders;

a second exhaust passage through which the exhaust gas from the second exhaust collecting section is to flow, the second exhaust passage being connected to the second exhaust collecting section and having a curved shape to change a flow direction of the exhaust gas from a direction in which the exhaust gas is ejected from each of the second cylinders, the second exhaust passage including an outer wall provided on a radially outer side of the curved shape of the second exhaust passage; and a second exhaust sensor disposed on the outer wall of the second exhaust passage and including a second detector configured to detect a constituent of the exhaust gas, the second detector protruding from the outer wall of the second exhaust passage into an inside of the second exhaust passage.

6. The exhaust apparatus according to claim 5, wherein the outer wall of the first exhaust passage includes a first collision portion with which the exhaust gas having passed through the first detector of the first exhaust sensor collides, wherein the outer wall of the second exhaust passage includes a second collision portion with which the exhaust gas having passed through the second detector of the second exhaust sensor collides, and wherein a distance between the second detector of the second exhaust sensor and the second collision portion in the second exhaust passage is longer than a distance between the first detector of the first exhaust sensor and the first collision portion in the first exhaust passage.

* * * * *